US006270373B1

(12) United States Patent
Pham-Van

(10) Patent No.: US 6,270,373 B1
(45) Date of Patent: Aug. 7, 2001

(54) CONNECTOR WITH CONTACT

(75) Inventor: Jean Marie Pham-Van, Chenecey-Buillon (FR)

(73) Assignee: FCI Besancon SA, Besancon (FR)

( * ) Notice: Subject to any disclaimer, the term of this patent is extended or adjusted under 35 U.S.C. 154(b) by 0 days.

(21) Appl. No.: 09/526,773

(22) Filed: Mar. 16, 2000

(30) Foreign Application Priority Data

Mar. 18, 1999 (FR) ..... 99 03383

(51) Int. Cl.[7] ..... H01R 4/25
(52) U.S. Cl. ..... 439/418
(58) Field of Search ..... 439/418, 417, 439/425, 941, 676, 404, 862, 637

(56) References Cited

U.S. PATENT DOCUMENTS 4,915,645 * 4/1990 Konnemann et al. ..... 439/417
5,194,014 * 3/1993 McClune et al. ..... 439/404
5,749,750 * 5/1998 Yu et al. ..... 439/637
6,007,368 * 12/1999 Lorenz et al. ..... 439/418

FOREIGN PATENT DOCUMENTS

0194052 A1 9/1986 (EP) .
0227153 A1 7/1987 (EP) .
0478364 A1 4/1992 (EP) .

* cited by examiner

*Primary Examiner*—Gary Paumen
*Assistant Examiner*—P Nguyen
(74) *Attorney, Agent, or Firm*—Perman & Green, LLP

(57) ABSTRACT

A connector (1) having a contact (2) for being crimped by one side thereof onto a conductor (3) of a cable (4) is provided on the other side with an elastic tongue (7) which can contact a printed circuit introduced in such connector. The elastic tongue is allowed a wide displacement, due to the structure of the arm (6) which joins the elastic tongue to the insulation displacement device (8–10) held by a blade (5) of the contact (2).

8 Claims, 1 Drawing Sheet

CONNECTOR WITH CONTACT

Figure 1:
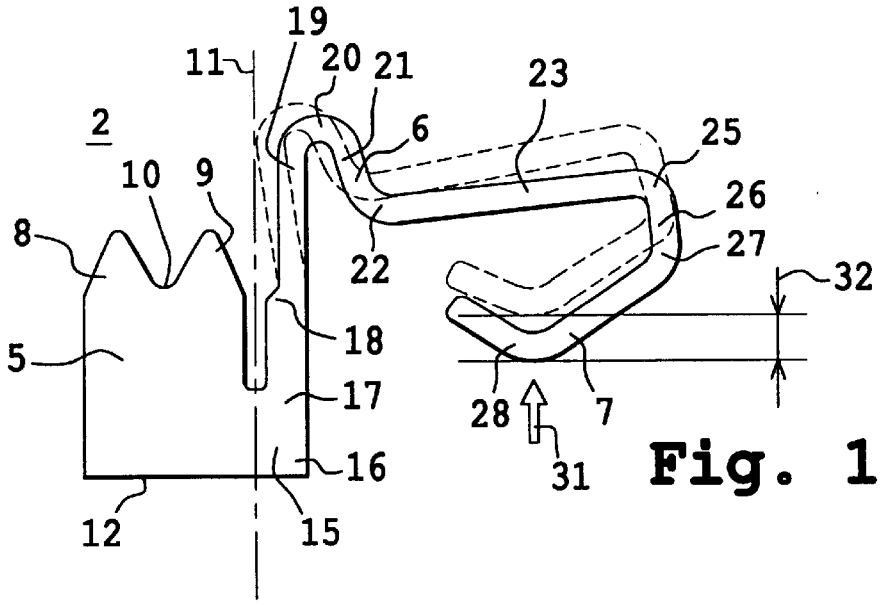

The invention relates to a connector having a contact. More particularly, it finds use in the field of connections, of telephony and computer applications, particularly of the RJ45 type. In prior art, in order to electrically connect two elements, for instance a cable and a printed circuit, two complementary connectors are used, each comprising a contact complementary to the other. These two contacts are to be connected together. Each contact is connected by a first end to one of the two elements, and has, at the other end, a rigid surface to be applied to the one of the complementary contact. The invention provides a single contact, comprised in a single connector, which may be directly connected to the two elements to be electrically connected. The interest of the invention lies in that a lower number of components is needed to connect two elements together.

In prior art, a first contact is connected to a first element. This first element is, for instance, a cable. The first contact is comprised in a first connector. This first contact includes an insulation displacement device, to allow electric connection thereof to the conductors of the cable. It also has a free edge for contacting a second contact. The edge of the first contact is a flat and rigid surface. The second contact is connected to a second element. This second element is, for instance, the metal plating of a printed circuit. In this case, the second contact is fastened to this second element by welding. The second contact is comprised in a second connector, complementary to the first connector. It also has accessible flat and rigid surfaces, which may contact the edge of the first contact.

Prior art connectors involve a first dimensional problem. In fact, prior art connectors are composed of many components: at least two complementary connectors and two contacts being allowed to be connected together. The provision of two connectors implies a construction which is incompatible with the miniaturization of the assembly.

The number of components of the assembly implicitly requires a number of actions for assembling such connection device and for making the connection. In fact, contacts have to be inserted into a connector, connectors have to be connected to the elements and finally, connectors have to be connected together.

Also, a prior art RJ45 connector cannot allow to reversibly connect two elements like a cable and a printed circuit. In fact, the printed circuit is flat and rigid. It has no cavity allowing to accommodate the RJ45 connector which also has flat and rigid contacts. Further, even when the printed circuit has a device for fastening a RJ45 connector, the quality of electric connections between two flat contacts is not assured. In fact, if a gap or clearance exists between the contact of the connector and the metal plating of the printed circuit, which is not foreseen by the fastening device, the connection will not be effected. Such a connector does not allow direct connections to printed circuits whose flatness is imperfect. If a jaw is provided as a fastening device, carried by the connector for accommodating the printed circuit, the thickness variation of printed circuits is such that electric contact is not effectively ensured.

It is an object of the invention to obviate the above drawbacks by providing a single connector comprising a contact which may be electrically connected by its ends to two elements. The contact particularly allows a first end to be connected to a cable thanks to an insulation displacement device for insulator removal. At a second end, the contact has an elastic tongue which allows to force said tongue against a rigid and flat element, e.g. a printed circuit. The elastic tongue is a device which allows to ensure a reliable electric connection to a rigid element. This second rigid and flat element is thereby connected to the cable.

Also, the contact in accordance with the invention has a joint for connecting these two ends. This joint allows, on the one hand, to dispose the elastic tongue in the connector, in a location wherein it will be free and capable to contact a printed circuit. Further, this joint allows a wider displacement of the elastic tongue with respect to the contact body. The contact thus conceived may be adapted to contact several different types of rigid and flat elements, other than printed circuits, or printed circuits with different thicknesses.

A RJ45 plug, wherein this contact is inserted, is designed to fit into a receptacle. Such receptacle has a printed circuit projecting out of one of its apertures. Here, the printed circuit is held perpendicular to the plane formed by the aperture. The tongue of this contact is forced against the metal plating of the printed circuit upon introduction of the printed circuit in the aperture. The curve followed by the tongue ensures electric connection to the metal plating, while admitting a slight variability of the circuit position, as well as a slight variation of its thickness.

Therefore, the invention addresses a connector having a contact which comprises a body provided at one end with a rigid blade holding an insulation displacement means for connection to a conductor of a cable, characterized in that it has an elastic tongue at a second end, and an arm joining the rigid blade to the elastic tongue.

Figure 2A:
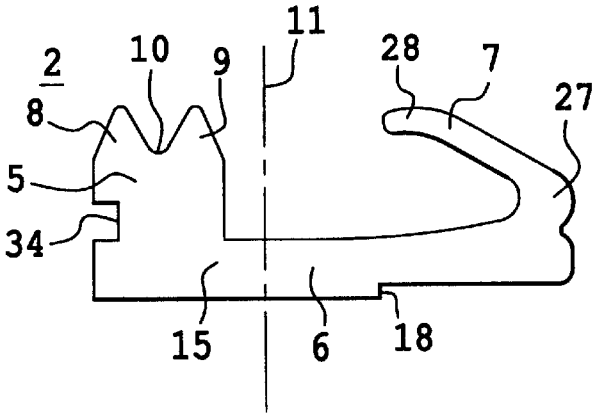
Figure 2B:
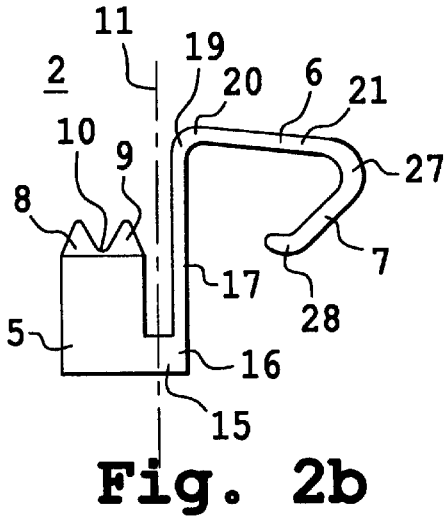
Figure 3:
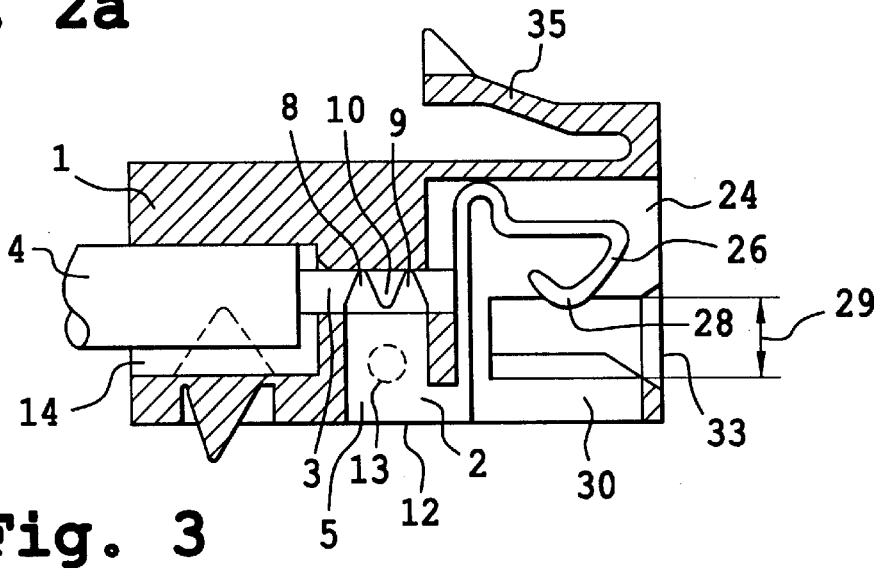

The invention will be understood more clearly by reading the following description and by analyzing the accompanying figures. The latter are only shown by way of example and do not intend to limit the invention in any manner. The figures show:

FIG. 1: a view of a preferred example of a contact according to the invention, with a stress is acting thereupon;

FIGS. 2*a* and 2*b:* two further examples of contacts according to the invention;

FIG. 3: a view of the contact as shown in FIG. 1, inserted into a connector according to the invention.

A connector 1 in accordance with the invention, as shown in FIG. 3, comprises a contact 2 mounted onto the conductors 3 of a cable 4. The contact 2, as shown in FIG. 1, has a rigid blade 5 joined to an elastic tongue 7 by an arm 6. The contact 2 is flat and preferably cut out flat into a metal sheet, which allows to effectively control its elasticity, hence the pressure force on the printed circuit. In one example, the contact is 0.25 mm thick. The blade 5 is placed at a first end of the contact 2. The blade 5 has a first tooth 8 and a second tooth 9. The teeth 8 and 9 are separated by a recess 10. The teeth 8 and 9 rise up on the blade 5, in the plane of the contact 2. They rise up parallel to an axis 11. The blade 5 has an overall parallelepiped shape. The recess 10 accommodates a conductor 3 of the cable 4, whereas the teeth 8 and 9 penetrate such conductor 3 and divide its wires. The teeth 8 and 9 and the blade 5 are more resistant than the conductors 3. In fact, when pressure is applied on an edge 12 of the contact 2, the blade 5 and the teeth 8 and 9 remain intact, and penetrate a sheath of the conductors 3. The contact 2 is preferably made from a phosphor bronze alloy, obtained by die forming.

The teeth 8 and 9 are sharp-edged so as to contact the (invisible) core of the conductor 3. The edge 12 is perpendicular to the plane formed by the contact 2. In FIG. 3, the contact 2 is inserted into the connector 1 by applying a force, parallel to the plane thereof, on the edge 12. This force is applied, for instance, by a crimping clamp. The assembly is conducted in two steps. First, the contact is mounted in a narrow housing for the body of the connector 1, in a preloaded position. In this position, a space for introducing the conductors 3 remains open. In order to keep the contact in this preloaded state, the blade has deformations over its plane, i.e. one or more bosses 13 resting against the walls of the narrow housing. Then, the contacts 2 are sunk from their preloaded position into the conductors 3 of the cable 4, previously introduced into a cavity 14 of the connector 1. Hence, the connector 1 is electrically connected to the cable 4.

The arm 6, as shown in FIG. 1, extends from the blade 5. A first segment 15 of this arm 6 extends perpendicular to the axis 11 of the blade 5. In FIG. 1, the arm 6 forms a bend 16 delimiting a second segment 17 of the arm 6. The segment 17 extends parallel to the axis 11. The segment 17 has a variable width. It particularly has a narrower part 18. Such narrower part 18 is situated after a wider part of the segment 17. The segment 17 borders one side of the blade 5. In one example, the segment 17 is longer than the blade 5 topped by the teeth 8 and 9.

The segment 17 forms, at an end 19 opposite to the bend 16, a second bend 20. The bend 20 is such that a part 21 of the arm 6 folds along and parallel to, the end 19 of the segment 17. This part 21 is short and defines a loop, immediately after the bend 20, by a third bend 22. This bend 22 delimits a second part 23 of the arm 6. This part 23 extends perpendicular to the axis 11. The bend 22 covers an angle of about 90°. The part 23 has a length defined to be smaller than the depth of a cavity 24, as shown in FIG. 3, for housing the arm 6. The part 23 is delimited by a fourth bend 25, covering about 90°, opposite to the bend 22. The part 23 determines a last segment 26 of the arm 6. The segment 26 is thus substantially parallel to the axis 11. In short, the arm 6 is composed of segments 15, 17, 21, 23 and 26, and also comprises bends 16, 20, 22 and 25. The multiply bent structure provides an increased stiffness, hence a controlled elasticity of the arm 6, while admitting a wide displacement thereof.

The elastic tongue 7 is joined to the segment 26 of the arm 6 by a last bend 27. The elastic tongue 7 has a curved shape. The curve of the elastic tongue 7 forms a contact bend. This contact bend 28 is oriented parallel to the axis 11. The elastic tongue 7 is shorter than the portion 23. Also, the elastic tongue 7 extends below the portion 23.

The elastic tongue schematically has a v shape, the vertex of the v being the contact bend 28. Here, the vertex of the v is oriented opposite to the tips formed by the teeth 8 and 9. The contact bend 28 is designed to contact a contact of a connector which is complementary thereto, in the broad sense. This complementary connector may be a receptacle adapted to the connector 1. The considerable displacement of the flexible tongue 7 allows to fill the clearance which can exist between these two connectors.

When a printed circuit, as shown in FIG. 3, is inserted into the cavity 24, the metal plating of the printed circuit can contact the contact bend 28 of the elastic tongue 7. The cavity 24 has a height 29, which enables the introduction of a printed circuit having a thickness below said height 29. The cavity 24 has a lower edge for accommodating a printed circuit. Prior to the introduction of the printed circuit, the contact bend 28 protrudes inside the cavity 24. The height 29 reduced by the contact bend 28, which protrudes inside the cavity 24, is shorter than the typical thickness of a printed circuit. As a variant, the contact bend 28 is engaged in a groove of the lower edge 30 through which the contact 2 has been inserted. In the latter case, the segment 26 is slanted to allow the tongue 7 to be lifted upon introduction of the printed circuit.

When a printed circuit is inserted into the cavity 24, it forces the contact bend 28, hence the assembly consisting of the elastic tongue 7 and of the arm 6 upwards, to find the space to accommodate its thickness inside the cavity 24. The introduction of a printed circuit generates a stress oriented in one direction 31, which is the same as the direction wherein the teeth 8 and 9 extend parallel to the axis 11. The elastic tongue 7 and the arm 6 are deformed by this stress, resulting in an elevation 32 of the contact bend 28. The elevation 32 transmitted to the different bends 27, 25, 22 and 20 results in an overall rotation of the arm 6. The contact 2 as shown in FIG. 1 provides a wider displacement and an increased stiffness, because the oriented stress 31 is transmitted to all the bends formed by this contact 2.

Since the contact is cut out flat, the contact bend 28 is sharp enough to penetrate a tin-plated contact area of the printed circuit, thereby generating a high-quality tight electric connection.

In a first variant of the contact 2, as shown in FIG. 2*a*, the arm 6 only has the segment 15 and the bend 27. Here, the arm 6 has no intermediate bends between the blade 5 and the elastic tongue 7. The arm 6 therefore consists of the segment 15, extending from the blade 5 perpendicular to the axis 11. In this case, the arm 6 is straight, and the bend 27 forms a 90° lower angle, so that the tongue 7 folds over the arm 6. The arm 6 also has, in the median part thereof, a narrower part 18.

A further characteristic of this variant is that it provides a contact bend 28 oriented in the same direction as the teeth 8 and 9. So, the connector 1 has a contact bend 28 whose displacement will occur in the lower part 30. Hence, the contact bend 28 can contact the metal plating of the printed circuit oriented towards the lower face 30. However, the contact 2 may be introduced into a part opposite to the lower part 30. This variant allows a poor flexibility, the admitted flexibility of the contact 2 lying in the bend 27 and in the contact bend 28. The displacement admitted by this contact 2 is narrower than the displacement 32 admitted by the contact as shown in FIG. 1. The contact 2 as shown in FIG. 2*a* tolerates a smaller difference between thicknesses of the different printed circuits, which may be introduced into the cavity 24. However, this structure is less fragile and more compact. Typically, the latter type of contact is connected to the conductors of the cable upon molding of the body of the connector 1. Nevertheless, this contact may also be inserted into the connector 1. In this case, it is inserted by one front face 33 perpendicular to the lower part 30, introduced on the side of the cavity 24. The contact 2 is then kept inside the cavity 24 by means of a mortise 34 formed in the blade 5. This mortise 34 is fitted with a tenon held by the connector body. The mortise 34 is situated opposite to the point whereat the segment 15 is inserted into the blade 5. Bosses like 13 may be provided to keep the contact inside the cavity 24.

A further variant of the contact 2 is shown in FIG. 2*b*. In this variant, the contact 2 has an arm 6 which is slightly different from the arm 6 as shown in FIG. 1. Here, the arm 6 of the contact 2 does not have the bends 22 and 25. Further, it does not have the segments 23 and 26. The bend 20 forms a right angle, so that the segment 21 which is defined from the bend 20 is approximately perpendicular to the axis 11. This arm 6 is composed of the segments 15, 17 and 21, and comprises the bends 16, 20 and 27. The bend 27 delimits the arm 6 of the elastic tongue 7. The bend 27 is oriented so that the elastic tongue 7 folds below the segment 21 of the arm 6. Here, the bend 28 held by the elastic tongue 7 is oriented in the same direction as in FIG. 1. However, the displacement of the elastic tongue 7 is narrower than the one obtained with the contact as shown in FIG. 1, because the structure of the arm 6 is less flexible. Particularly, the bend 27 readily abuts against the ceiling of the cavity 24. The latter variant is less flexible. In fact, the arm 6 has a lower number of bends than the arm 6 as shown in FIG. 1. Like in FIG. 2*a,* this variant of the contact 2 has a lower tolerance with respect to the intrinsic variation which may exist between the thicknesses of printed circuits. The pressure force on the printed circuit is increased. This variant is preferably suitable for applications wherein a considerable insertion force is required, and the number of couplings has to be small.

The connector 1, as shown in FIG. 3, is of the RJ45 type, hence it has an elastic lever 35 above the cavity 24. This elastic lever 35 may be lowered to allow the introduction of the connector 1 inside an aperture of a receptacle containing a printed circuit to be connected to said connector. The metal plating to be connected to the connector can be placed on an upper or lower face of the printed circuit. According to the type of contacts as shown in FIGS. 1, 2*a* or 2*b,* the connection will be effected on one of the two faces of the printed circuit. Therefore, there may be provided connectors 1 comprising the different kinds of contacts 2, particularly in the case of double-faced printed circuits. The contacts 2 are each inserted into an individual narrow cell of the connector 1.

What is claimed is:

1. A connector having a contact which comprises a rigid blade at a first end, an elastic tongue at a second end and an arm joining the rigid blade to the elastic tongue, the rigid blade holding an insulation displacement mean to be inserted in an insulative sheath and to be connected with a conductor of a cable, the elastic tongue comprising a contact bend adapted to be forced against a conducting element inserted in the connector and wherein the arm comprises at least two bends and the elastic tongue comprises a last bend;

wherein the tongue has a curved shape extending within a plane of the body;

wherein the arm has two bends and a curve of the elastic tongue comprises a contact bend in direction opposite to the direction wherein the two teeth rise up.

2. A connector as claimed in claim 1, wherein the arm is flexible and comprises four bends.

3. A connector as claimed in claim 1, wherein the insulation displacement means comprises a first tooth separated from a second tooth by a recess.

4. A connector as claimed in claim 1, wherein the arm is straight, the two teeth rise up in one direction, and one curve of the elastic tongue comprises the contact bend in the same direction.

5. A connector as claimed in claim 1, wherein the arm of the contact comprises an open loop.

6. A connector as claimed in claim 1, wherein the arm has a wider part to absorb the stresses exerted against the elastic tongue.

7. A connector as claimed in claim 1, wherein the blade has a mortise for being kept inside the connector.

8. A connector as claimed in claim 7, wherein the blade has at least one deformation of its plane for being kept inside a housing of the connector in a preloaded position.

* * * * *